US008992337B1

(12) United States Patent
Koziol et al.

(10) Patent No.: US 8,992,337 B1
(45) Date of Patent: Mar. 31, 2015

(54) PORTABLE TODDLER SWING

(71) Applicant: HoneyBee Child LLC, Menlo Park, CA (US)

(72) Inventors: Jill P. Koziol, Menlo Park, CA (US); Katherine C. Stewart, Chapel Hill, NC (US)

(73) Assignee: HoneyBee Child LLC, Menlo Park, CA (US)

( * ) Notice: Subject to any disclaimer, the term of this patent is extended or adjusted under 35 U.S.C. 154(b) by 5 days.

(21) Appl. No.: 14/089,615

(22) Filed: Nov. 25, 2013

Related U.S. Application Data

(60) Provisional application No. 61/827,748, filed on May 27, 2013.

(51) Int. Cl.
*A63G 9/10* (2006.01)
*A47D 1/10* (2006.01)

(52) U.S. Cl.
CPC ..... *A63G 9/10* (2013.01)
USPC ..... 472/118; 297/273; 297/484

(58) Field of Classification Search
CPC ..... A63G 9/00; A63G 9/12; A47D 1/10; A47D 13/105; A47C 3/00
USPC ..... 472/118, 120, 121, 122, 123, 124, 125; 297/273, 274, 484, 485, 487, 467
See application file for complete search history.

(56) References Cited

U.S. PATENT DOCUMENTS

| | | | | |
|---|---|---|---|---|
| 4,037,764 | A * | 7/1977 | Almosnino et al. | 224/160 |
| 4,382,595 | A | 5/1983 | Tolar | |
| 5,533,934 | A | 7/1996 | Miller | |
| 7,175,535 | B1 | 2/2007 | Marmentini | |
| 7,578,746 | B1 * | 8/2009 | Johnson | 472/118 |
| 2006/0220437 | A1 | 10/2006 | Merson | |

* cited by examiner

*Primary Examiner* — Kien Nguyen
(74) *Attorney, Agent, or Firm* — Miles & Stockbridge PC

(57) ABSTRACT

A portable toddler swing is provided. The swing includes a compliant shell, an upper adjustable strap, a fastener coupled to the upper adjustable strap, a lower adjustable strap, a pair of support straps and a pair of safety fasteners. The shell defines an inner cavity, including an upper portion defining a top opening and a circumferential passage, a bottom portion, a front portion defining a pair of leg openings, a back portion, and a pair of side portions. The upper adjustable strap is slidingly disposed within the circumferential passage, and adjusts the size of the top opening of the shell. The lower adjustable strap is connected to the bottom portion of the shell, and secures the shell to a playground swing seat. The pair of safety fasteners are coupled to upper portions of the support straps, and secure the support straps to the playground swing chains.

16 Claims, 23 Drawing Sheets

PORTABLE TODDLER SWING

CROSS-REFERENCE TO RELATED APPLICATIONS

This application is a Nonprovisional of U.S. Patent Application Ser. No. 61/827,748, filed on May 27, 2013, the disclosure of which is incorporated herein by reference in its entirety.

TECHNICAL FIELD

The present invention relates to swings, and, more particularly, the present invention relates to a portable toddler swing.

BACKGROUND

Playgrounds and swings are gathering places for families with children of all ages. The vast majority of playgrounds feature standard swings with a seat base and two chains connecting the seat base to a support structure. Because these standard swings require a user to properly balance and support themselves on the seat base, infants and toddlers under the age of three are unable to safely use the swing. As a result, infants and toddlers are unable to enjoy standard swings at local playgrounds unless a separate toddler swing is present and unoccupied. Toddlers are also unable to enjoy a wide variety of other swing platforms including tire swings. A swing is therefore needed which allows the safe conversion of a variety of swing platforms to a toddler swing allowing infants and toddlers to fully enjoy all varieties of swing platforms either swinging unaccompanied or with a caretaker.

In addition, while toddler swings are sometimes available for use, their construction is uncomfortable, not adjustable for size, a breeding ground for germs, and often constructed from heat conducting material making these traditional toddler swings not ideal for a young child. What is therefore needed is a safe, comfortable, clean, and size adjustable platform for swinging, providing infant and toddlers an opportunity to enjoy the same playground as older children and allowing caretakers to more effectively supervise all children.

SUMMARY

Embodiments of the present invention advantageously provide a portable toddler swing that includes a compliant shell, an upper adjustable strap, a fastener coupled to the upper adjustable strap, a lower adjustable strap, a pair of support straps and a pair of safety fasteners. The shell defines an inner cavity, and includes an upper portion defining a top opening and a circumferential passage, a bottom portion, a front portion defining a pair of leg openings, a back portion, and a pair of side portions. The upper adjustable strap is slidingly disposed within the circumferential passage, and adjusts the size of the top opening of the shell. The lower adjustable strap is connected to the bottom portion of the shell, and secures the shell to a playground swing seat. The pair of support straps are respectively attached to the side portions of the shell, and include upper portions extending above the upper portion of the shell. The pair of safety fasteners are respectively coupled to the upper portions of the support straps, and secure the support straps to a pair of playground swing chains.

Other embodiments of the present invention advantageously provide a method of swinging with a child in a playground swing that includes placing a child into a portable toddler swing, securing the child within the portable toddler swing, sitting in the playground swing seat, and securing the portable toddler swing to the playground swing by attaching a pair of safety fasteners to the playground swing chains such that the bottom portion of the portable toddler swing is above the playground seat.

There has thus been outlined, rather broadly, certain embodiments of the invention in order that the detailed description thereof herein may be better understood, and in order that the present contribution to the art may be better appreciated.

Before explaining at least one embodiment of the invention in detail below, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
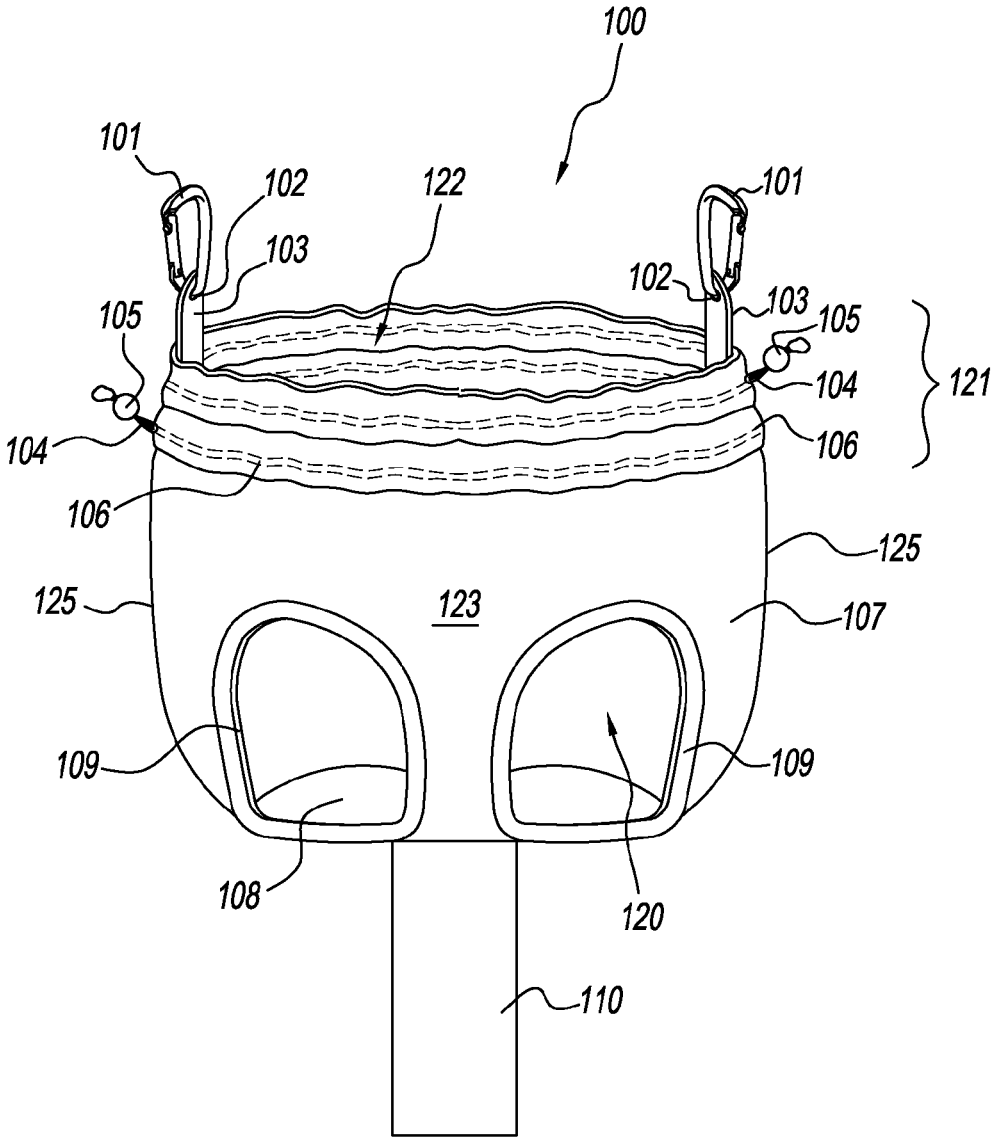
FIGS. 1 and 2 are front and back views, respectively, of a portable toddler swing, according to an embodiment of the present invention.

The invention will now be described with reference to the drawing figures, in which like reference numerals refer to like parts throughout.

Embodiments of the present invention advantageously provide a portable toddler swing that temporarily converts a variety of playground swings into a toddler swing. The toddler swing includes a soft seat, several integrated adjustable straps, safety fasteners, and an optional storage compartment with an integrated storage bag. The safety fasteners are connected to each side of the toddler swing and attach to the chains of the playground swing, advantageously allowing a child to swing unaccompanied or with an adult, depending on the height at which the swing is connected to the playground swing chains. The toddler swing is light, collapsible, and easy to carry comfortably in an optional integrated storage bag that is hidden in a storage compartment on the back of the swing.

Referring to FIGS. 1-5, embodiments of the present invention advantageously provide a portable toddler swing 100 that includes a compliant shell 107, at least one upper adjustable cord or strap 104, a fastener 105 for the upper adjustable strap 104, a lower adjustable strap 110, and a pair of support straps 103 with safety fasteners 101.

The shell 107 defines an inner cavity 120, and includes an upper portion 121 defining a top opening 122 and at least one circumferential passage 106, a front portion 123 defining a pair of leg openings 109, a back portion 124, a bottom portion 108 and side portions 125. The shell 107 generally supports the child across the chest, back, and under arms. The leg holes 109 allow for easy placement of the child into, and out of, the swing 100. The shell 107 may be made from a cloth or cloth-like material, such as, for example, canvas, and may include additional padding material.

Figure 2:
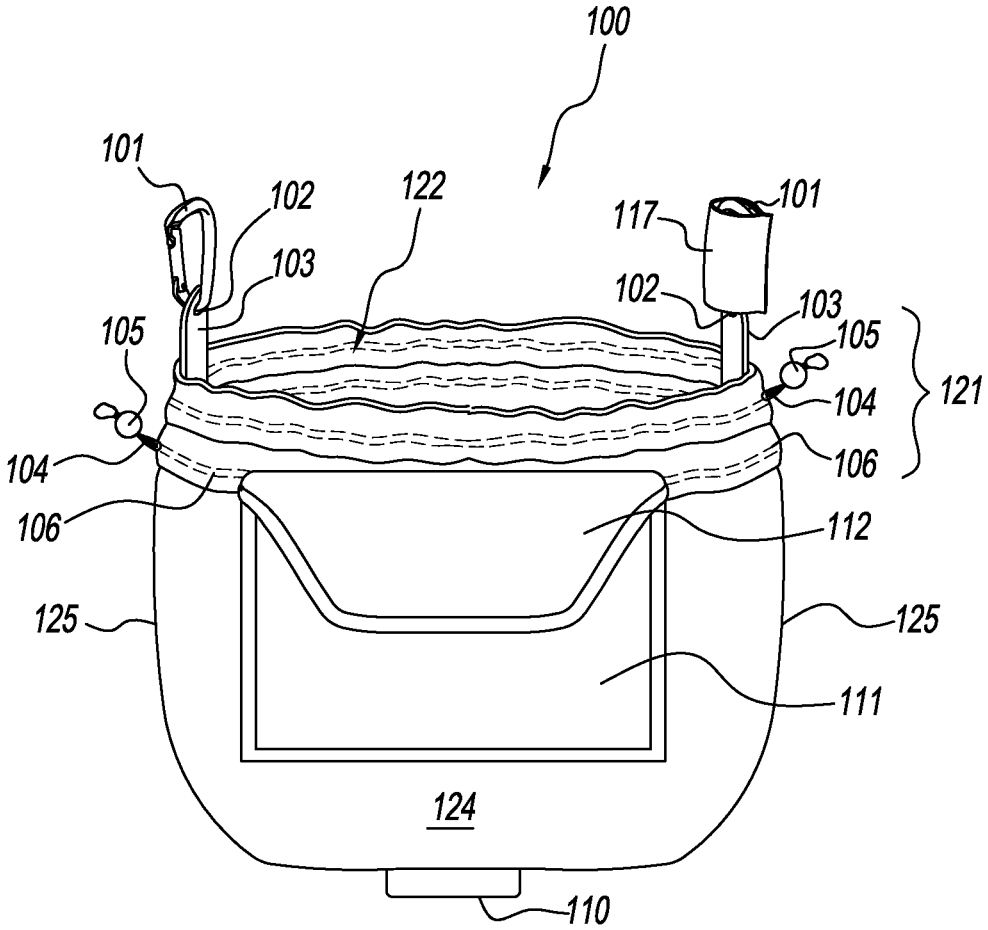
Figure 3:
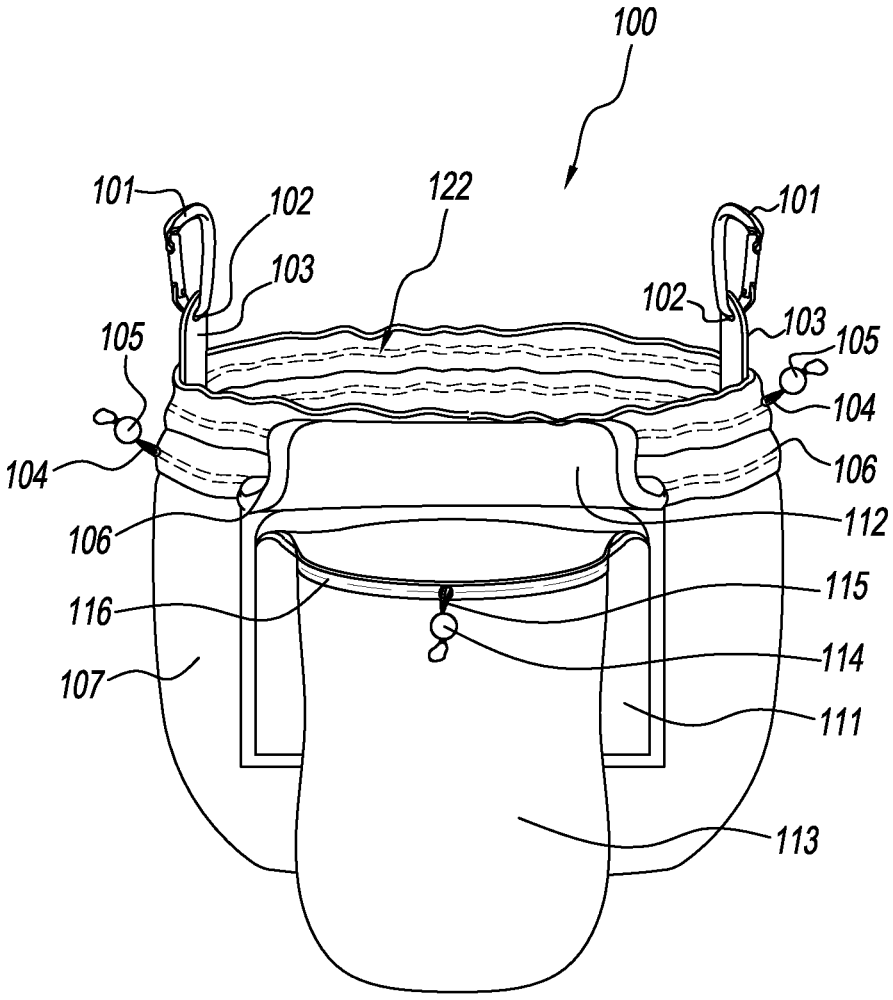
FIG. 3 is a further back view of a portable toddler swing, according to the embodiment depicted in FIGS. 1 and 2.
Figure 4:
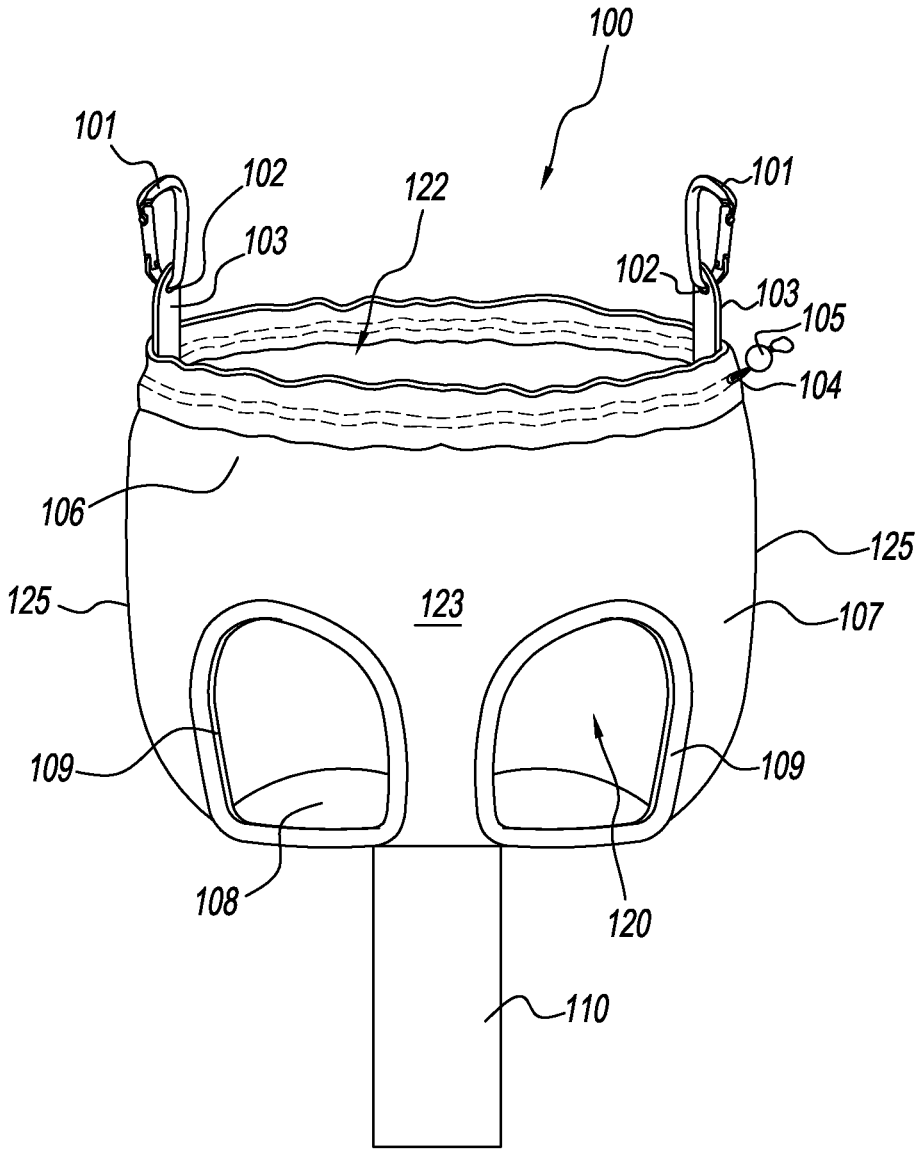
FIGS. 4 and 5 are front and back views, respectively, of a portable toddler swing, according to another embodiment of the present invention.
Figure 5:
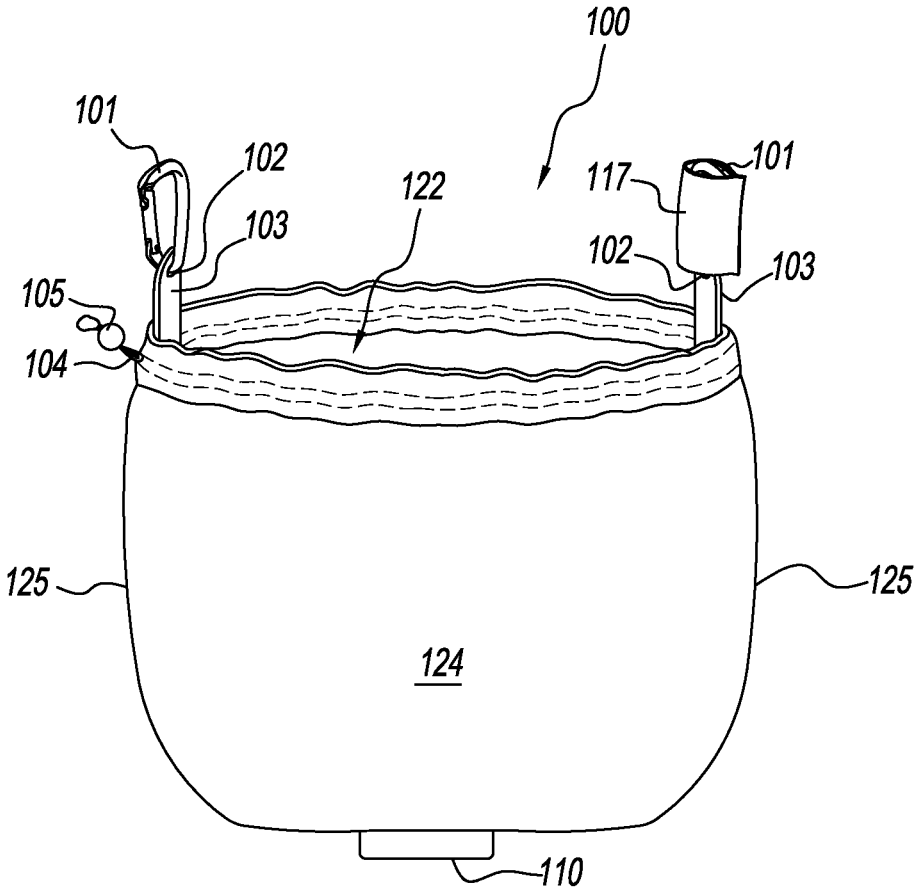
Figure 6A:
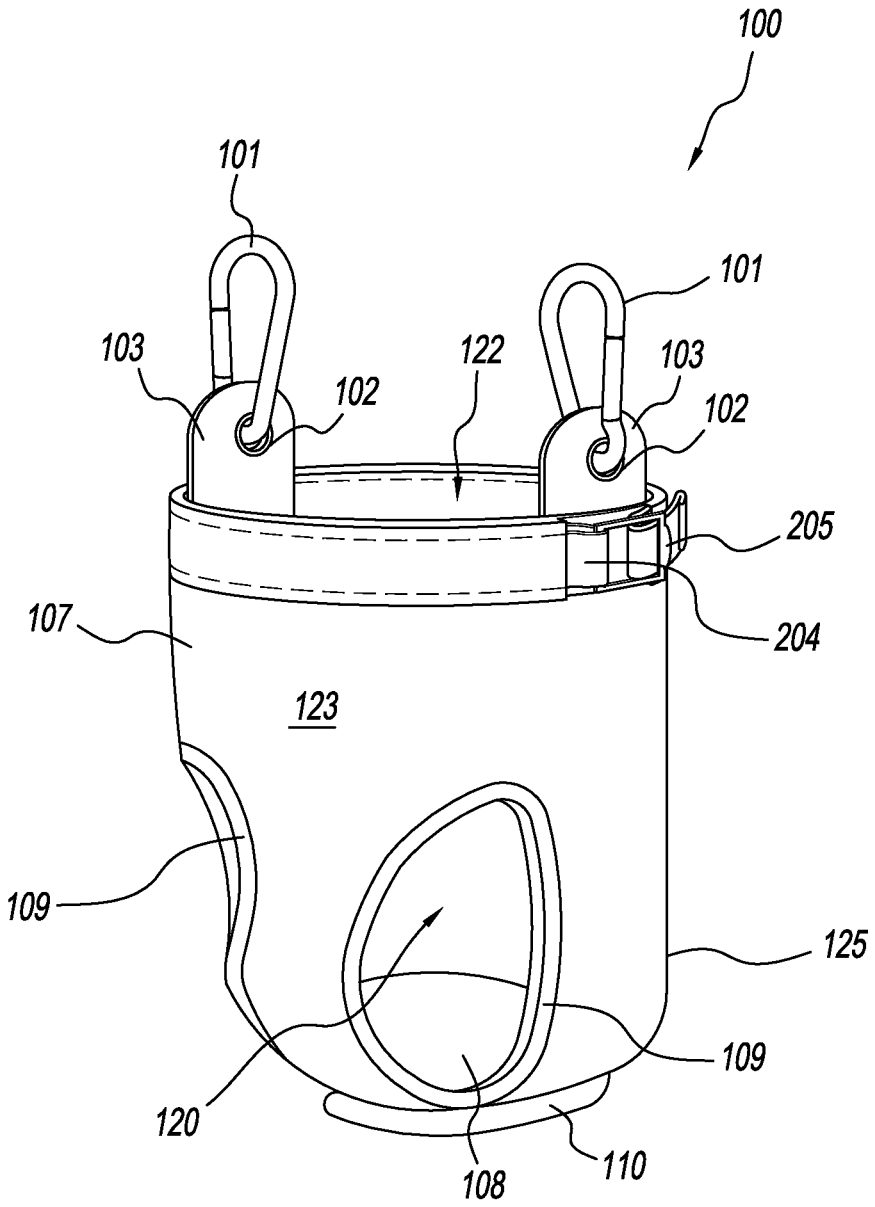
FIGS. 6A, 7A, 8A, 9A, 10A, 11A and 12A are perspective, front, back, right, left, top and bottom views, respectively, according to a further embodiment of the present invention.
Figure 6B:
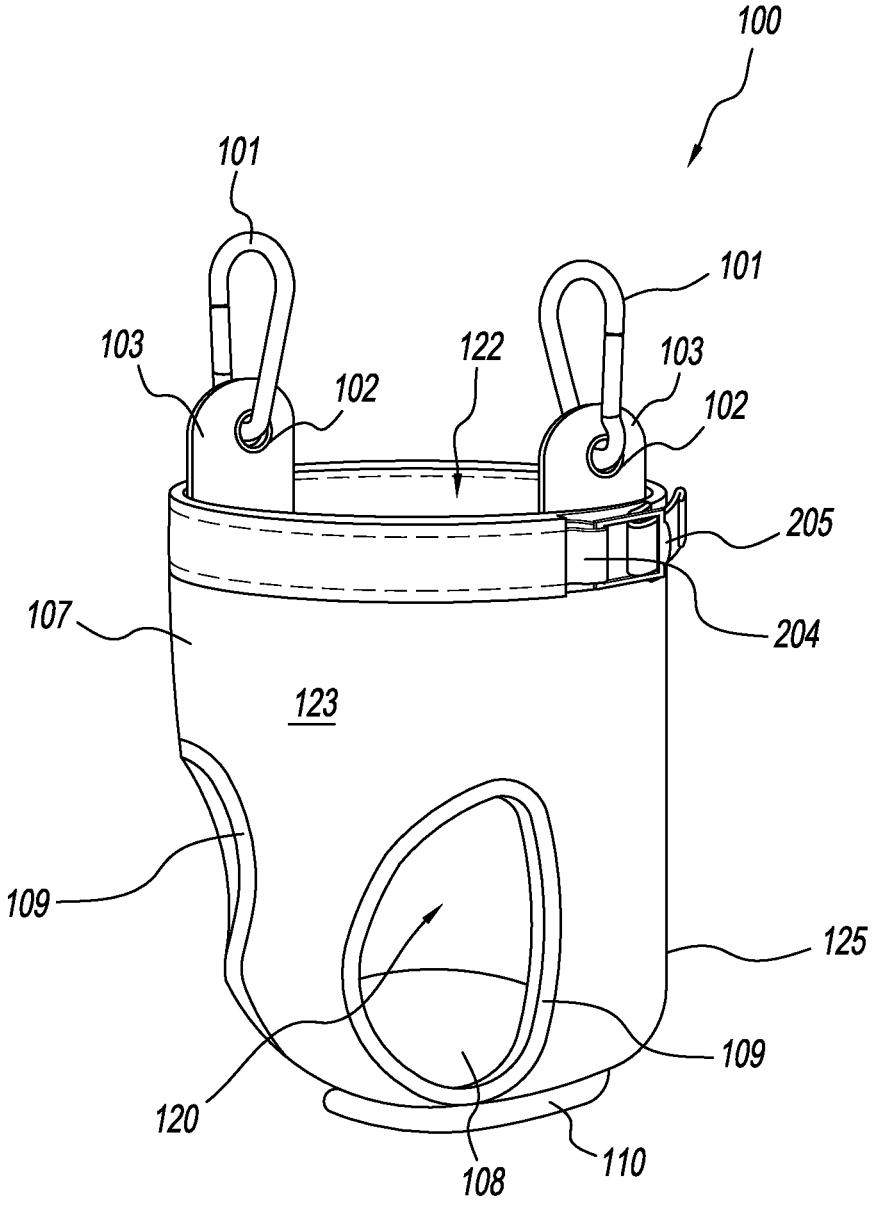
FIGS. 6B, 7B, 8B, 9B, 10B, 11B and 12B are perspective, front, back, right, left, top and bottom views, respectively, according to another further embodiment of the present invention.
Figure 7A:
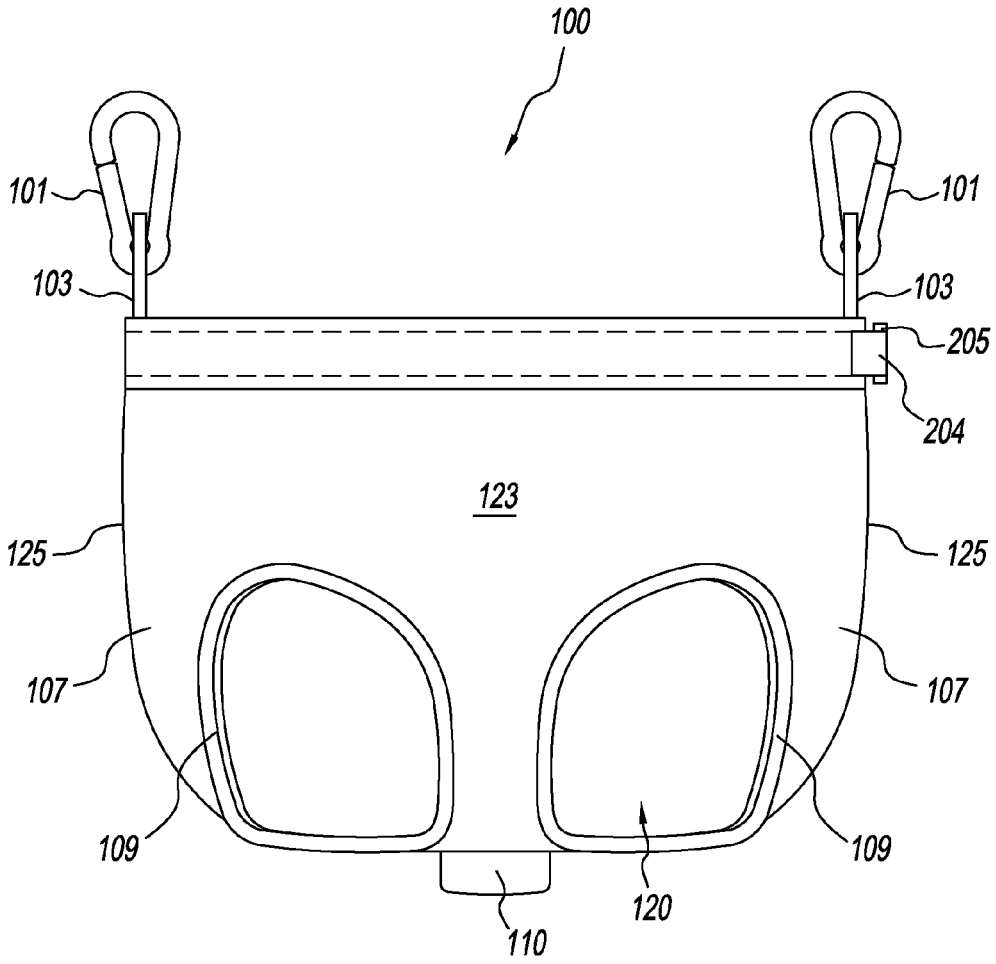
Figure 7B:
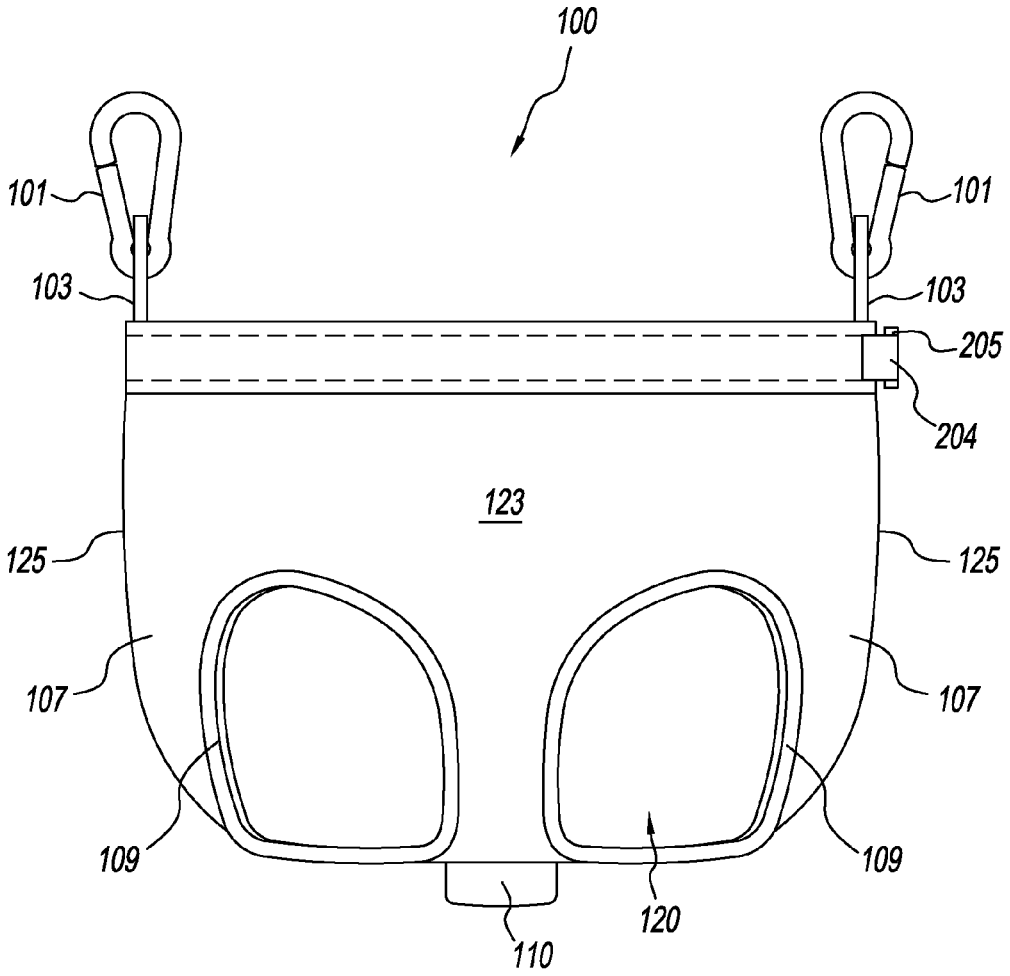
Figure 8A:
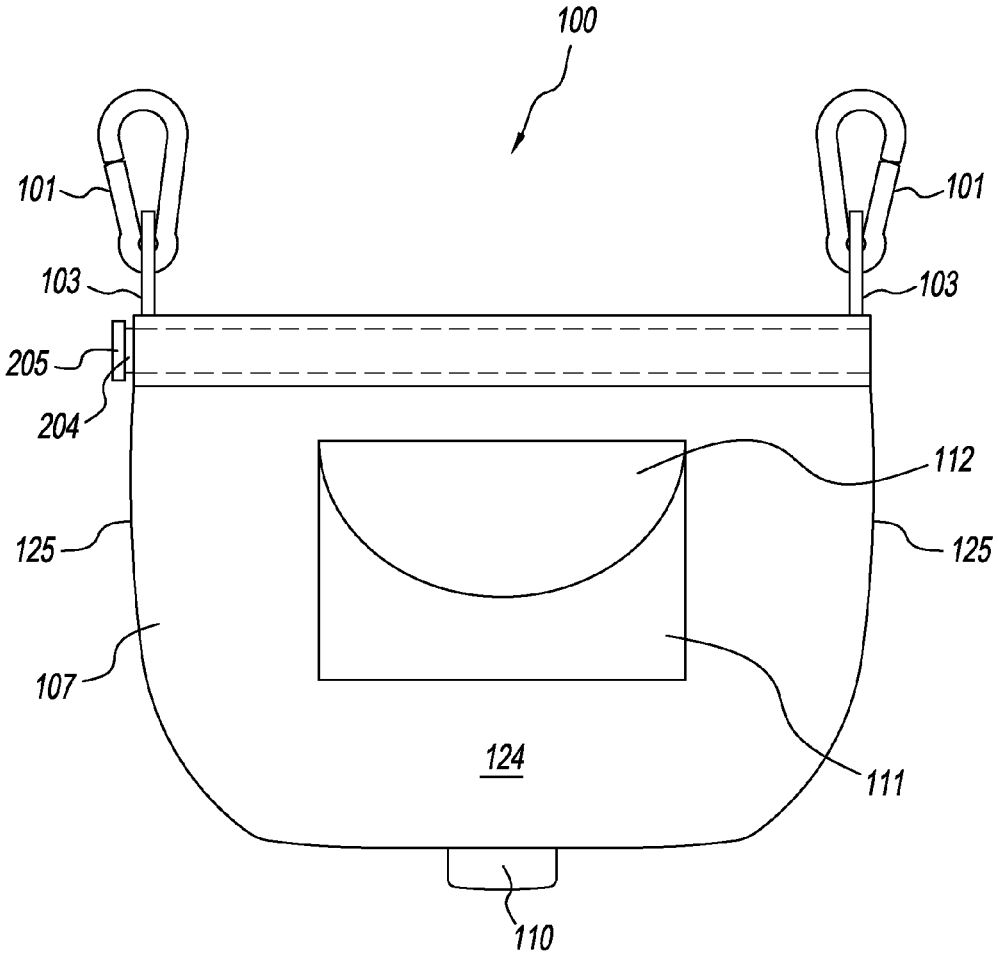
Figure 8B:
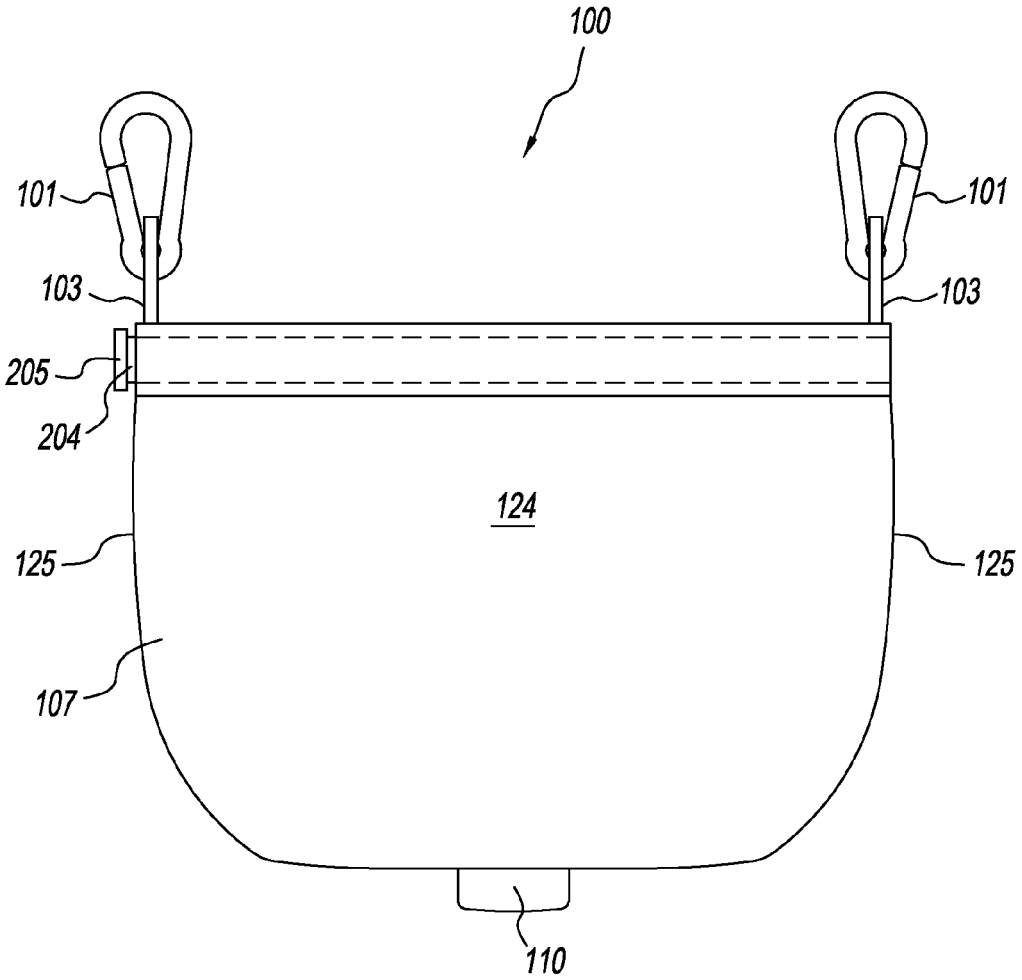
Figure 9A:
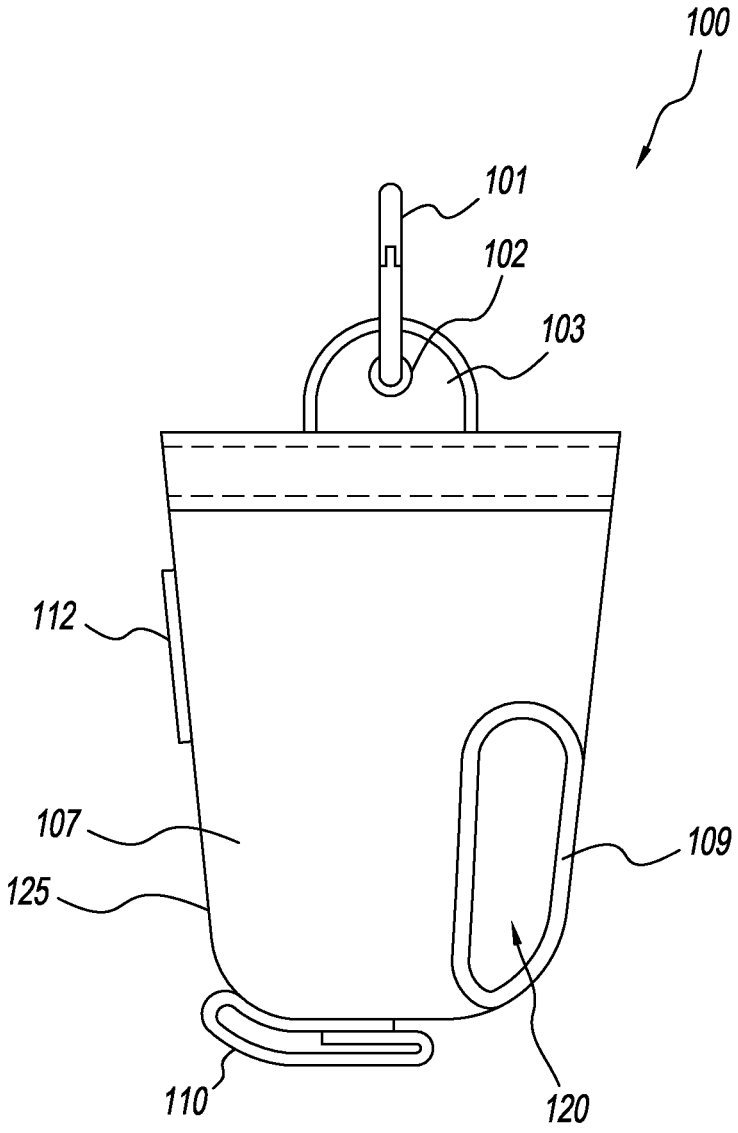
Figure 9B:
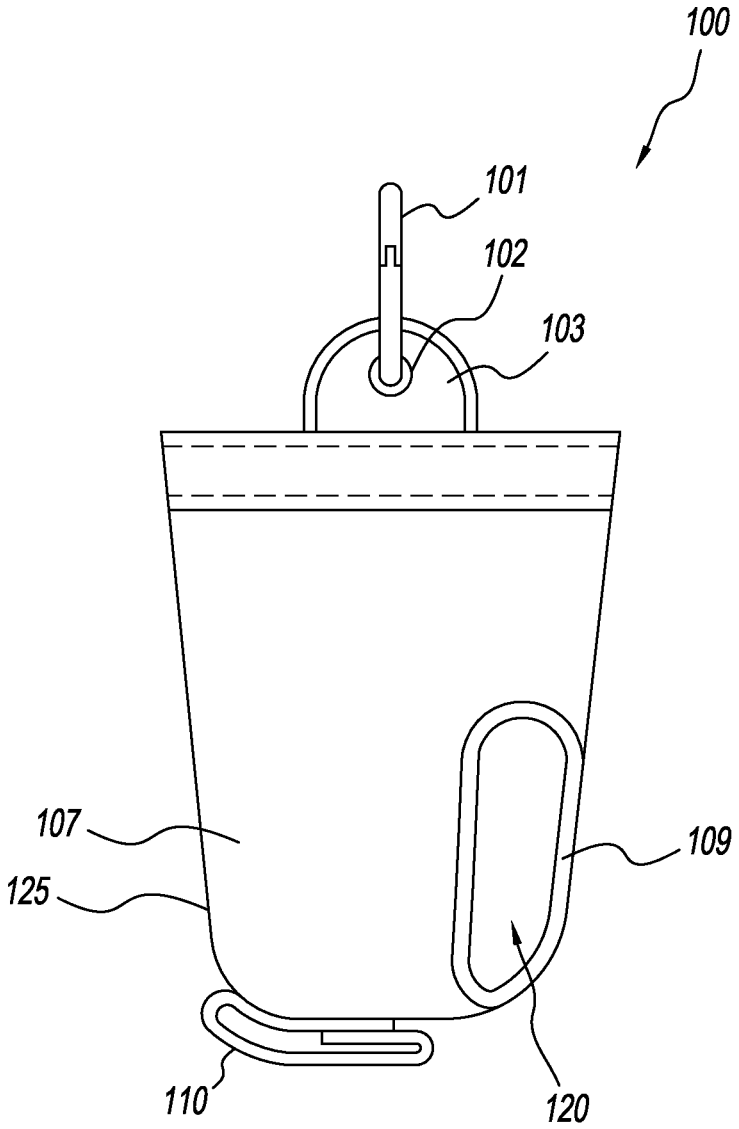
Figure 10A:
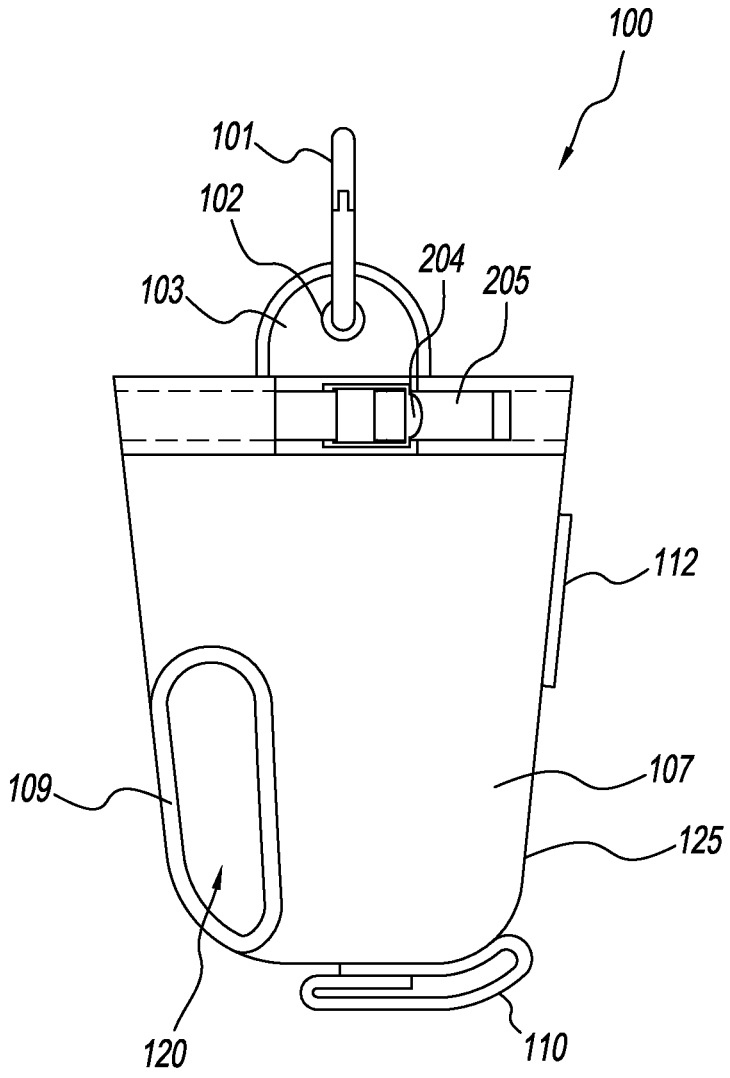
Figure 10B:
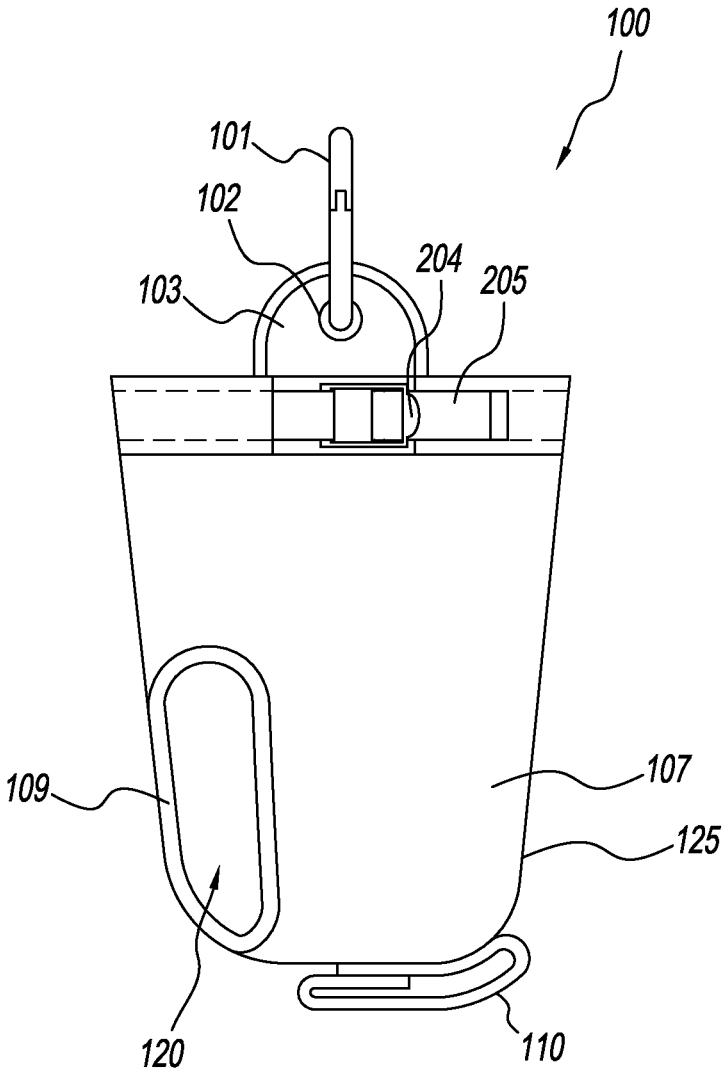
Figure 11A:
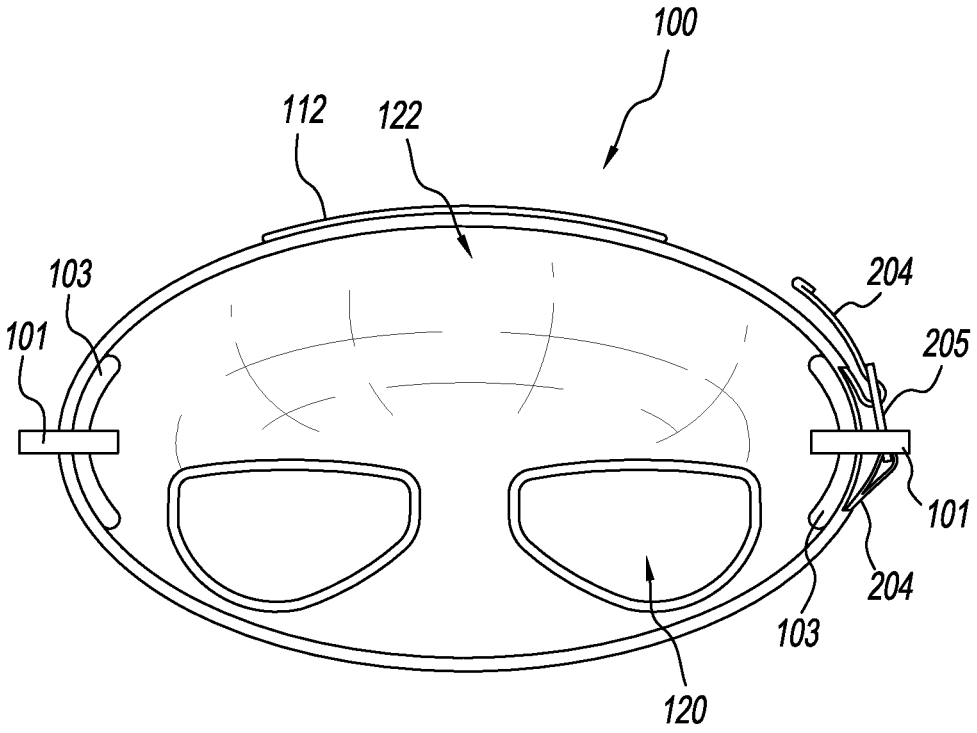
Figure 11B:
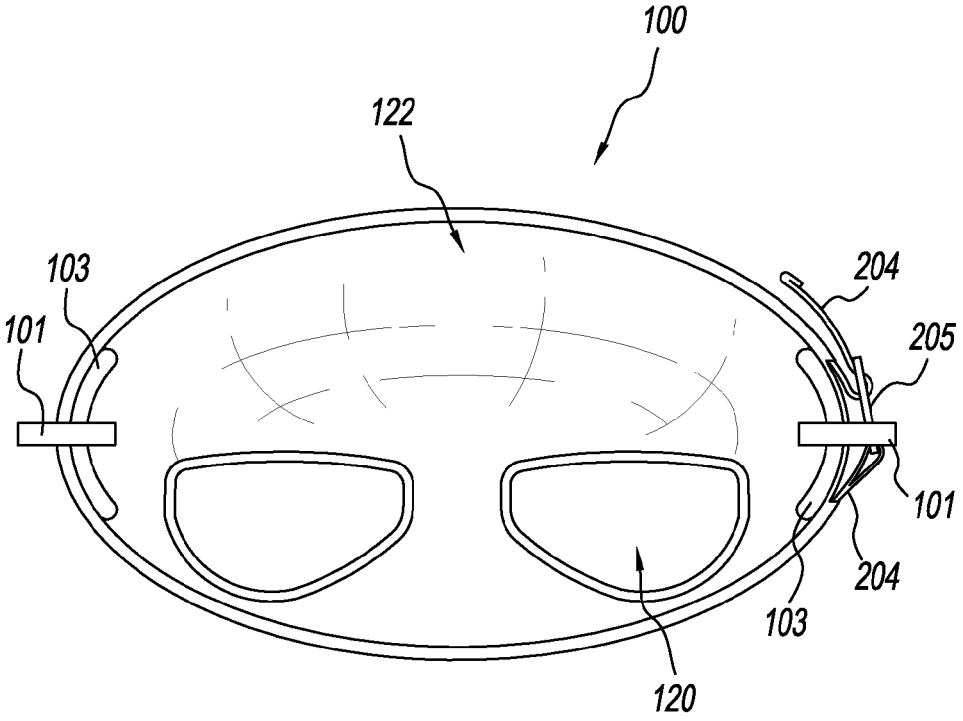
Figure 12A:
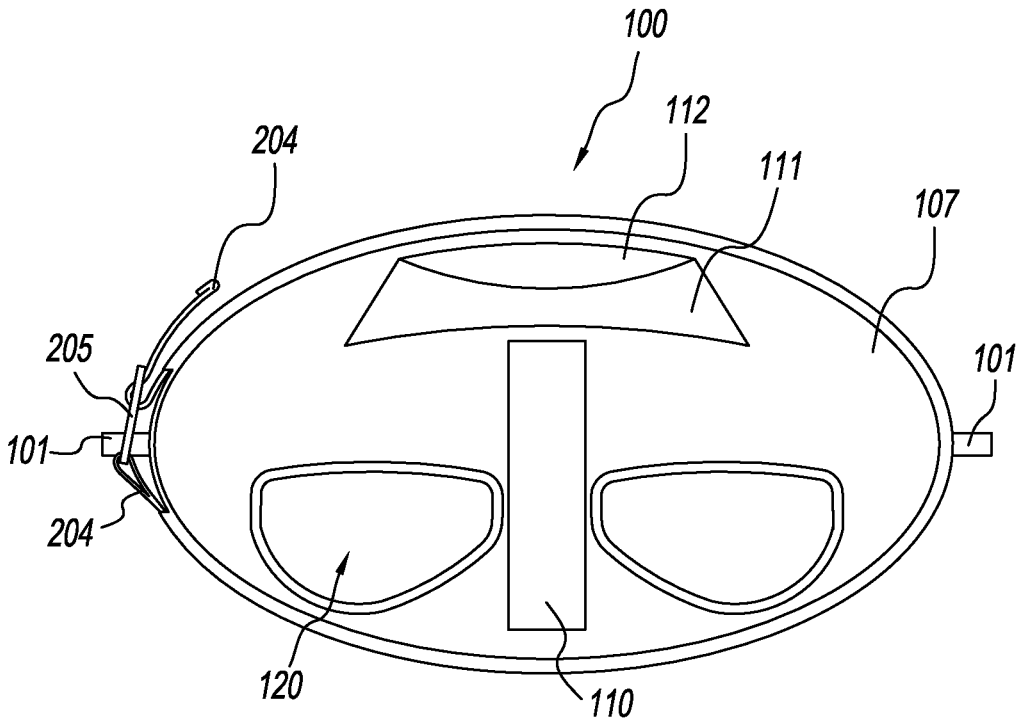
Figure 12B:
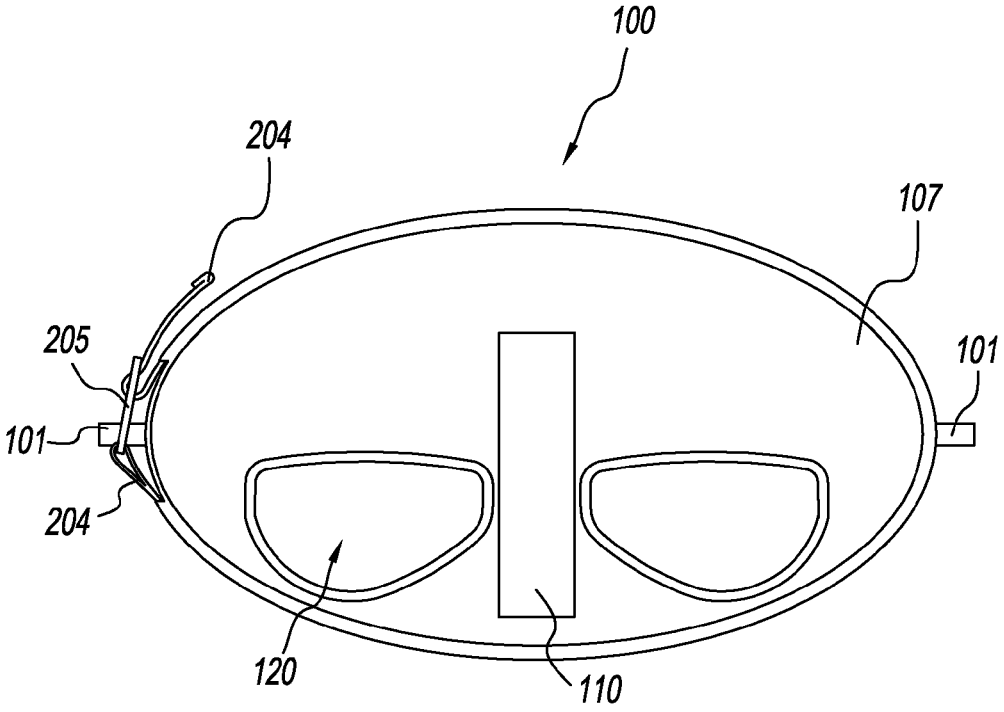

The upper adjustable strap 104 is slidingly disposed within the passage 106 to adjust the size of the top opening 122. The upper adjustable strap 104 allows the caretaker to adjust the fit of the swing 100 to the child, and may be tightened or loosened on one side of the shell 107, as depicted in FIGS. 4 and 5, or, alternatively, on each side of the shell 107, as depicted in FIGS. 1, 2 and 3. In various embodiments of the swing 100, the upper adjustable strap 104 may be tightened or loosened using a fastener 105, such as, for example, a toggle or similar device, which is slidingly attached to the ends of the upper adjustable strap 104 which pass through respective openings in the shell 107 connected to the passage 106. The fastener 105 is configured to accept and temporarily secure the upper adjustable strap 104 in place, thus securely holding the shell 107 to the body of the child. The upper adjustable strap 104 may be made from any suitable material, such as, for example, nylon, etc., or, alternatively, from an elastic material.

The lower adjustable strap 110 attaches the bottom portion 108 of the shell 107 to a playground swing seat 130 when the child is swinging unaccompanied, which advantageously provides additional stability and security. The lower adjustable strap 110 is securely attached to the bottom portion 108 of the shell 107, and is adjustable to allow for secure attachment to a variety of different playground swing seats. The lower adjustable strap 110 may use Velcro connections, clips, buckles, etc., or other attachment means, to secure the swing 100 to the playground swing seat 130. The lower adjustable strap 110 may be constructed of any suitable material, such as, for example, cloth, cloth fiber, nylon, etc. When not attached to playground swing seat 130, the lower adjustable strap 110 may be secured onto itself, or otherwise stored out of the way and in a convenient position.

Support straps 103 are attached to the side portions 125 of the shell 107, and the safety fasteners 101 are attached to the upper portions of the support straps 103 to secure the support straps 103 to a playground swing chain 131. A reinforced attachment point 102 may be located on each support strap 103, such as, for example, a grommet, reinforced fabric, etc., which is securely sewn into each support strap 103. The safety fasteners 101 advantageously distribute the weight of the child equally in the swing 100, and may be lockable or unlockable carabiner clips, etc. In certain embodiments of the swing 100, a protective strap or covering 117 may cover the safety fasteners 101 to protect the child's hands.

In various embodiments of the swing 100, an optional storage compartment 111 may be attached to the back portion 124 of the shell 107, and may include an integrated storage bag 113 and closure flap 112. The storage compartment 111 is attached to the back portion 124 of the swing 100 to allow for collapsing, storing, and carrying the swing 100 easily and comfortably. In some embodiments of the swing 100, the storage bag 113 has a circumferential passage 116, an adjustable cord 115 disposed within the passage 116, and a toggle 114 to close the storage bag when the shell 107 and accompanying components are stored therein.

Referring to FIGS. 6A, 7A, 8A, 9A, 10A, 11A and 12A, further embodiments of the present invention advantageously provide a portable toddler swing 100 that includes a compliant shell 107, at least one upper adjustable strap 204, a fastener 205 for the upper adjustable strap 204, a lower adjustable strap 110, and a pair of support straps 103 with safety fasteners 101.

As described above, the shell 107 defines an inner cavity 120, and includes an upper portion 121 defining a top opening 122 and a circumferential passage 106, a front portion 123 defining a pair of leg openings 109, a back portion 124, a bottom portion 108 and side portions 125. The shell 107 generally supports the child across the chest, back, and under arms. The leg holes 109 allow for easy placement of the child into, and out of, the swing 100. The shell 107 may be made from a cloth or cloth-like material, such as, for example, canvas, and may include additional padding material.

The upper adjustable strap 204 is slidingly disposed within the passage 106 to adjust the size of the top opening 122. The upper adjustable strap 204 allows the caretaker to adjust the fit of the swing 100 to the child, and may be tightened or loosened on one side of the shell 107. In various embodiments of the swing 100, the upper adjustable strap 204 may be tightened or loosened using a fastener 205, such as, for example, a ladder lock buckle or similar device, which is attached to the ends of the upper adjustable strap 204 which pass through respective openings in the shell 107 connected to the passage 106. The fastener 205 is configured to accept and temporarily secure the upper adjustable strap 204 in place, thus securely holding the shell 107 to the body of the child. The upper adjustable strap 204 may be made from any suitable material, such as, for example, nylon, etc., or, alternatively, from an elastic material.

As described above, the lower adjustable strap 110 attaches the bottom portion 108 of the shell 107 to a playground swing seat 130 when the child is swinging unaccompanied, which advantageously provides additional stability and security. The lower adjustable strap 110 is securely attached to the bottom portion 108 of the shell 107, and is adjustable to allow for secure attachment to a variety of different playground swing seats. The lower adjustable strap 110 may use Velcro connections, clips, buckles, etc., or other attachment means, to secure the swing 100 to the playground swing seat 130. The lower adjustable strap 110 may be constructed of any suitable material, such as, for example, cloth, cloth fiber, nylon, etc. When not attached to playground swing seat 130, the lower adjustable strap 110 may be secured onto itself, or otherwise stored out of the way and in a convenient position.

As described above, support straps 103 are attached to the side portions 125 of the shell 107, and the safety fasteners 101 are attached to the upper portions of the support straps 103 to secure the support straps 103 to a playground swing chain 131. A reinforced attachment point 102 may be located on each support strap 103, such as, for example, a grommet, reinforced fabric, etc., which is securely sewn into each support strap 103. The safety fasteners 101 advantageously distribute the weight of the child equally in the swing 100, and may be lockable or unlockable carabiner clips, etc.

Referring to FIGS. 6B, 7B, 8B, 9B, 10B, 11B and 12B, further embodiments of the present invention advantageously provide an optional storage compartment 111, attached to the back portion 124 of the shell 107, that includes an integrated storage bag 113 and closure flap 112. The storage compartment 111 is attached to the back portion 124 of the swing 100 to allow for collapsing, storing, and carrying the swing 100 easily and comfortably. In some embodiments of the swing 100, the storage bag 113 has a circumferential passage 116, an adjustable cord 115 disposed within the passage 116, and a toggle 114 to close the storage bag when the shell 107 and accompanying components are stored therein.

The present invention also contemplates the accommodation of larger children, adults with disabilities, etc. For example, the size of the shell can be increased and reinforced, as needed, to support the larger size and weight of these individuals. Additionally, the shell may be modified to facilitate placement of the swing adapter on the individual, such as, for example, adding a pair of zippers running from the top portion 121 to each leg opening 109, etc.

Figure 13:
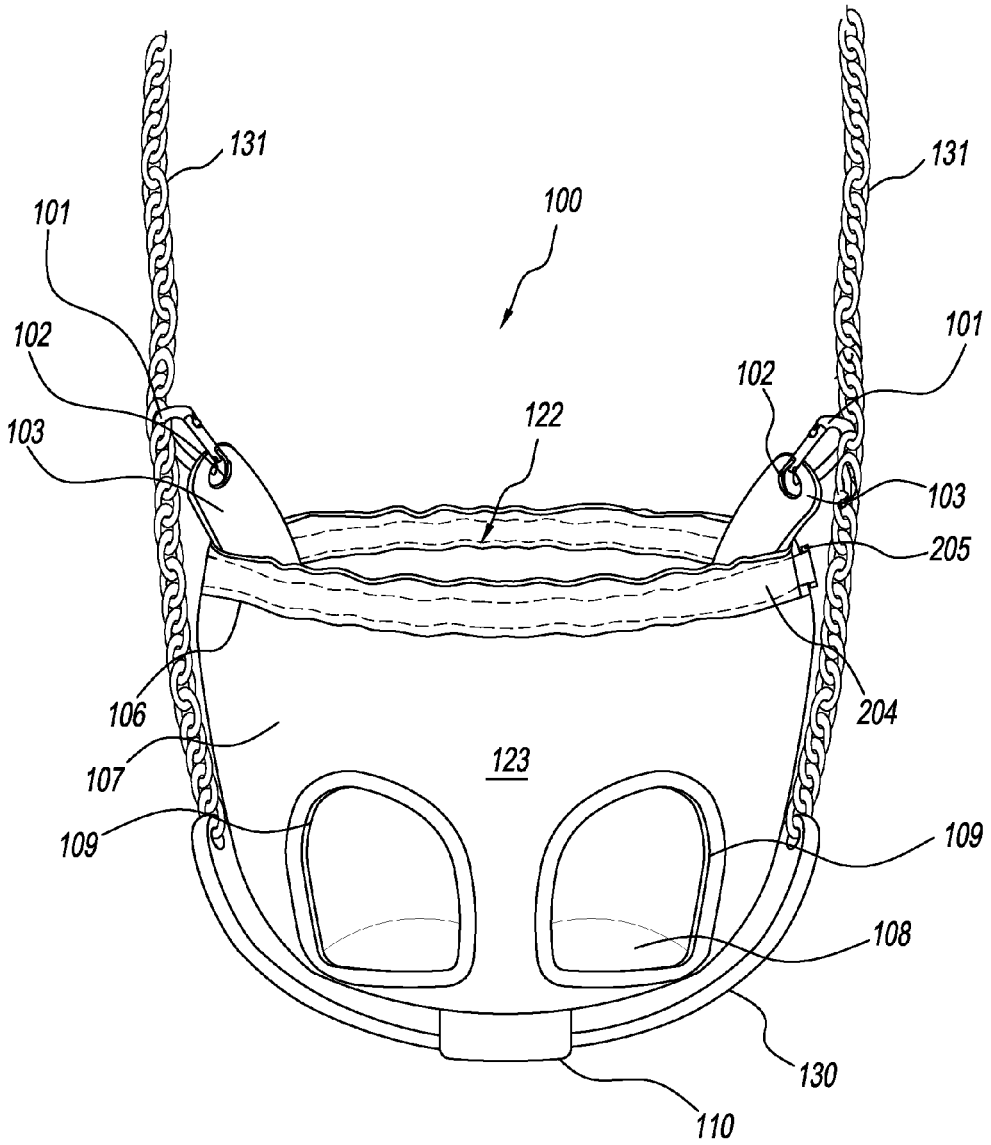
FIG. 13 is a front view of a portable toddler swing attached to a playground swing, according to an embodiment of the present invention.
Figure 14:
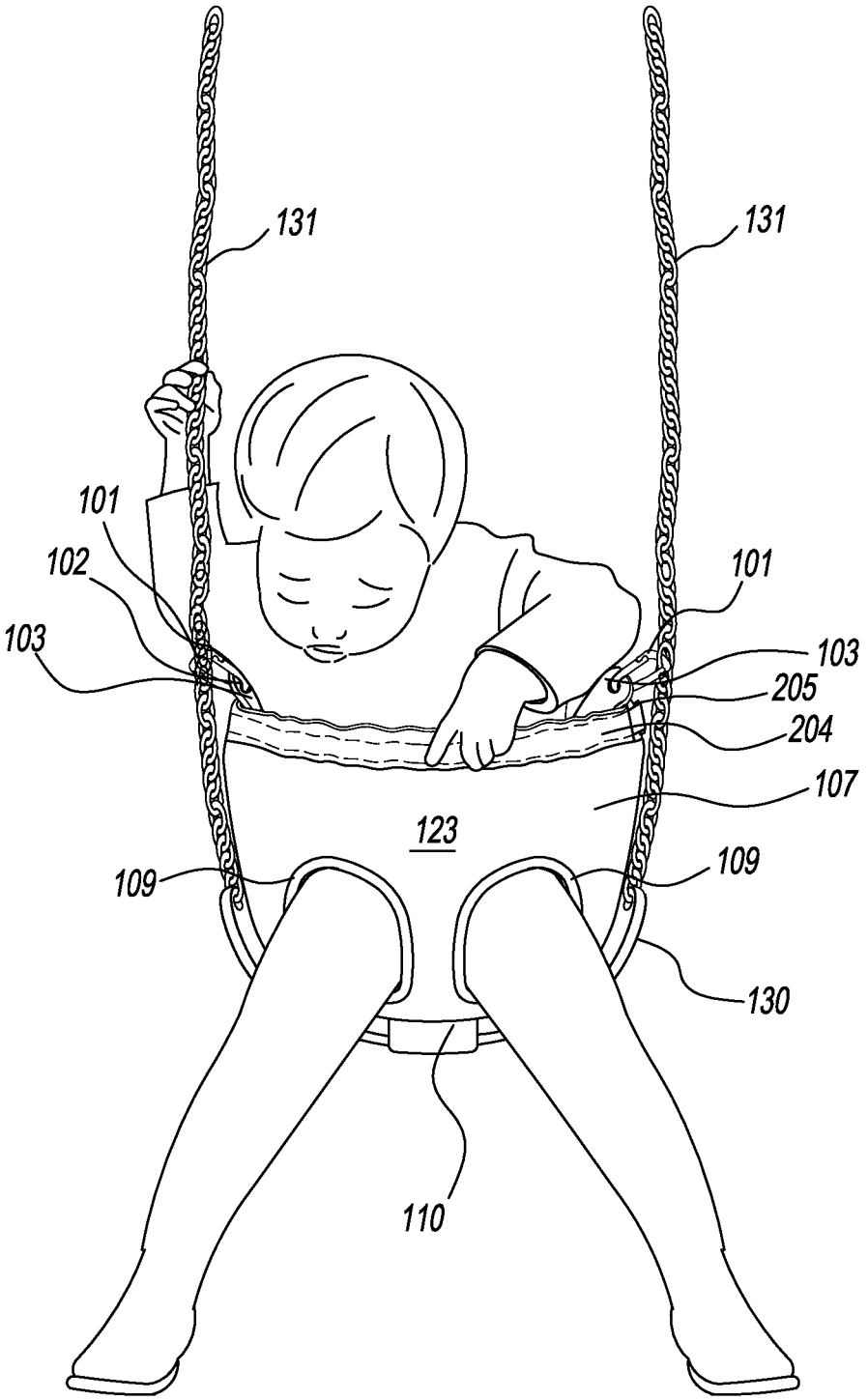
FIG. 14 is a front view of a portable toddler swing attached to a playground swing with a toddler secured therein, according to the embodiment depicted in FIG. 13.
Figure 15:
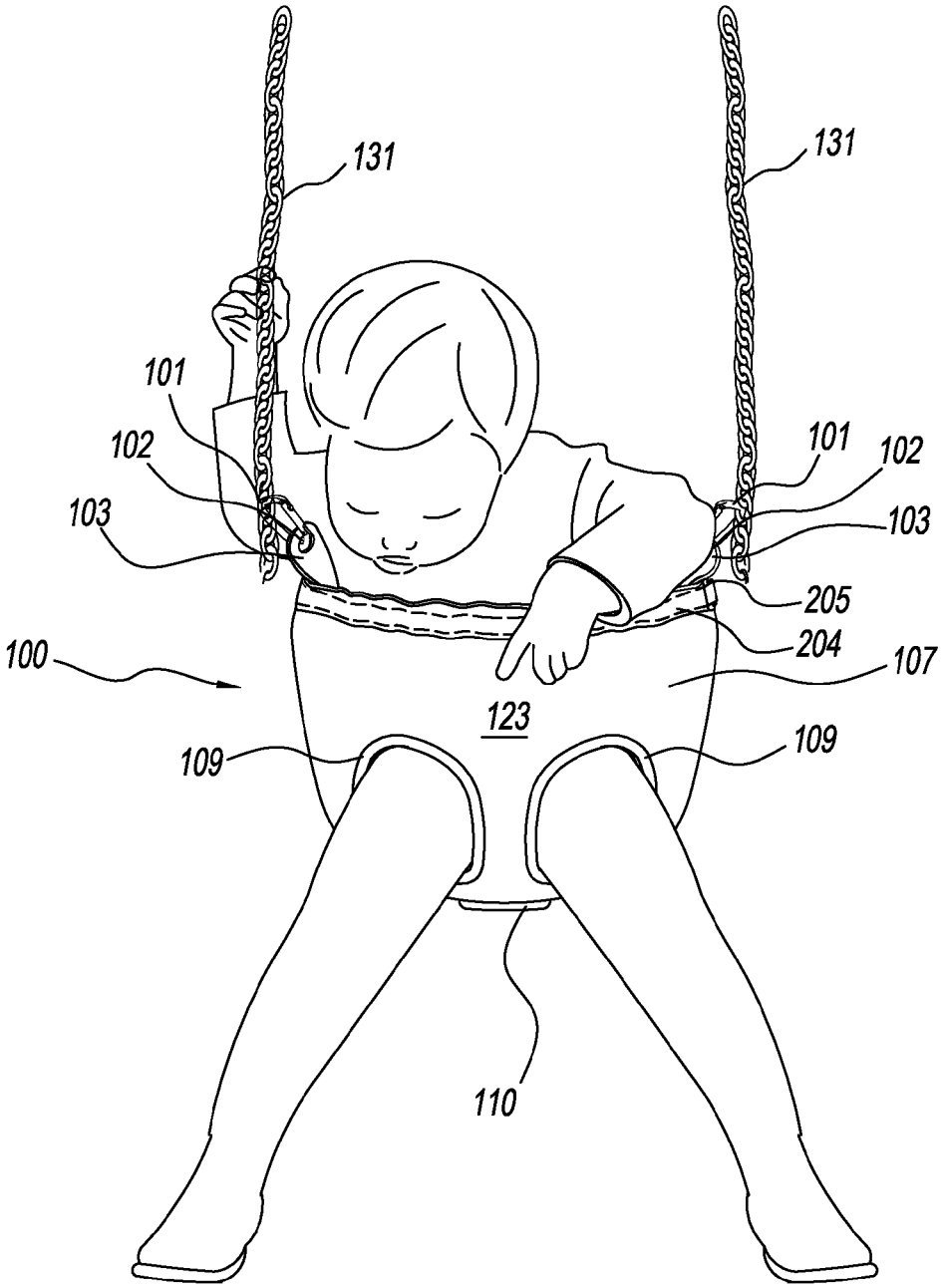
FIG. 15 is a front view of a portable toddler swing attached to a playground swing with a toddler secured therein, according to another embodiment of the present invention.
Figure 16:
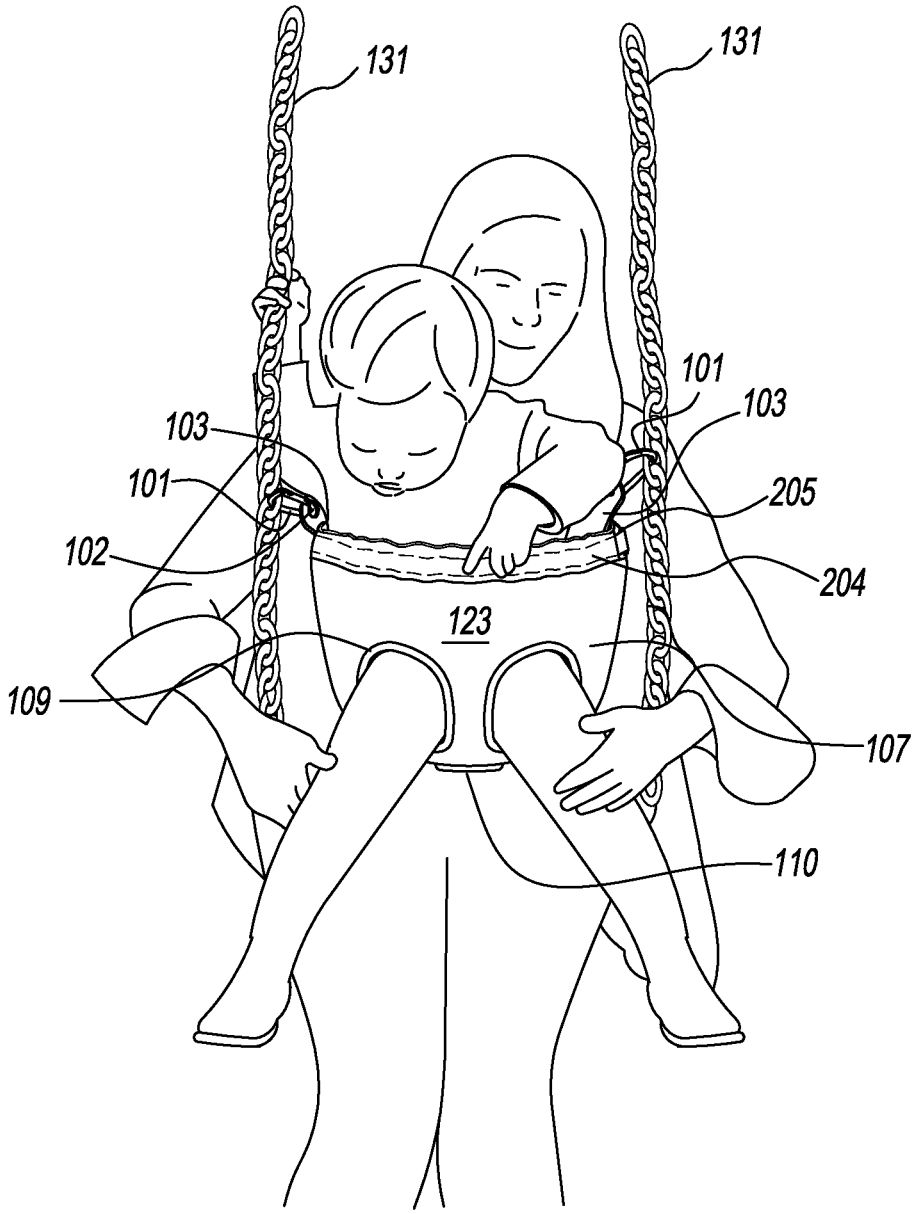
FIG. 16 is a front view of a portable toddler swing attached to a playground swing, with a toddler secured therein, and with an accompanying adult sitting on the playground swing, according to the embodiment depicted in FIG. 15.

Referring to FIGS. 13-16, in one embodiment, the caretaker places the child into the shell 107 and tightens the upper adjustable strap 104, 204, prior to attaching the swing 100 to the playground swing in order to confirm a secure fit. In another embodiment, the caretaker attaches the swing 100 to the playground swing seat 130 and chains 131 before the child is placed into and secured within the swing 100, as depicted in FIG. 13. Swing 100 easily and advantageously allows a child to swing independently, as depicted in FIGS. 14 and 15, or with a caretaker, as depicted in FIG. 16. For independent swinging, the swing 100 may be attached to the playground seat 130 and chains 131, as depicted in FIG. 14, or, alternatively, the swing 100 can be attached to the playground swing chains 131 such that the bottom portion 108 of the shell 107 is above the playground swing seat 130, as depicted in FIG. 15. Advantageously, the ability to hook the safety fasteners 101 to the playground swing chains 131 above the playground swing seat 130 allows the child to swing independently on a variety of different platforms, such as older straight seat swings, tire swings, any dual chain swing designs, swings with chains but without seats, etc., as well to swing with a caretaker sitting below on the playground swing seat 130.

In one embodiment of the present invention, a method of swinging with a child in a playground swing includes placing a child into the portable toddler swing 100, securing the child within the portable toddler swing 100, sitting in the playground swing seat 130, and securing the portable toddler swing 100 to the playground swing by attaching the safety fasteners 110 to the playground swing chains 131 such that the bottom portion 108 of the portable toddler swing 100 is above the playground seat 130. In this embodiment, after securing the child within the portable toddler swing 100, the child may be picked up before sitting in the playground swing seat 130 or after sitting in the playground swing seat 130. Alternatively, the child may be received from another person after sitting in the playground swing seat 130.

The many features and advantages of the invention are apparent from the detailed specification, and, thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and, accordingly, all suitable modifications and equivalents may be resorted to that fall within the scope of the invention.

What is claimed is:

1. A portable toddler swing, comprising:

a compliant shell, defining an inner cavity, including an upper portion defining a top opening and a circumferential passage, a bottom portion, a front portion defining a pair of leg openings, a back portion, and a pair of side portions;

an upper adjustable strap, slidingly disposed within the circumferential passage, to adjust the size of the top opening of the shell;

a fastener, coupled to the upper adjustable strap, to secure the upper adjustable strap;

a lower adjustable strap, connected to the bottom portion of the shell, to secure the shell to a playground swing seat;

a pair of support straps, respectively attached to the side portions of the shell, including upper portions extending above the upper portion of the shell; and a pair of safety fasteners, respectively coupled to the upper portions of the support straps, to secure the support straps to a pair of playground swing chains.

2. The swing according to claim 1, wherein the support straps each include a grommet for respectively coupling the pair of safety fasteners to the upper portions thereof.

3. The swing according to claim 1, wherein the fastener for the upper adjustable strap is a toggle.

4. The swing according to claim 1, wherein the fastener for the upper adjustable strap is a ladder lock buckle.

5. The swing according to claim 1, wherein the upper portion of the shell defines an additional circumferential passage, and further comprising an additional upper adjustable strap, slidingly disposed within the additional circumferential passage, to adjust the size of the top opening of the shell, and an additional fastener, coupled to the additional upper adjustable strap, to secure the additional upper adjustable strap.

6. The swing according to claim 1, further comprising a storage compartment, attached to the back portion of the shell, including an integrated storage bag.

7. The swing according to claim 1, wherein the storage compartment includes an integrated storage bag.

8. The swing according to claim 7, wherein the storage bag has a collapsed state and an expanded state, in the collapsed state the storage bag fits within the storage compartment, and in the expanded state the shell, the upper and lower adjustable straps, the support straps and the safety fasteners fit within the storage bag.

9. The swing according to claim 8, wherein the storage bag includes a passage surrounding a top opening, an adjustable strap disposed within the passage, an opening thorough which the ends of the adjustable strap pass, and a fastener, slidingly attached to the ends of the adjustable strap, to secure selective portions of the ends of the adjustable strap outside of the passage.

10. The swing according to claim 1, further comprising a protective strap to cover each safety fastener.

11. The swing according to claim 1, wherein the shell is made of nylon or canvas material, and the leg openings are reinforced with additional nylon or canvas material.

12. The swing according to claim 1, wherein the lower portion of the shell includes padding.

13. A method of swinging with a child in a playground swing, comprising:

placing a child into a portable toddler swing, the portable toddler swing including a shell having a top opening through which the child is received, a pair of leg openings through which the legs of the child are extended, a bottom portion to provide a seat for the child, and a pair of support straps;

securing the child within the portable toddler swing by adjusting the size of the top opening of the shell using an upper adjustable strap that is slidingly disposed within a circumferential passage around the top opening of the shell, and locking the upper adjustable strap in place using a fastener coupled to the ends of the upper adjustable strap;

sitting in the playground swing seat; and securing the portable toddler swing to the playground swing by attaching a pair of safety fasteners, coupled to respective upper portions of the shell support straps, to the playground swing chains such that the bottom portion of the shell is above the playground seat.

14. The method according to claim 13, further comprising picking up the child, secured within the portable toddler swing, before sitting in the playground swing seat.

15. The method according to claim 13, further comprising picking up the child, secured within the portable toddler swing, after sitting in the playground swing seat.

16. The method according to claim 13, further comprising receiving the child, secured within the portable toddler swing, from another person after sitting in the playground swing seat.

* * * * *